US012389953B2

(12) United States Patent
Perez

(10) Patent No.: US 12,389,953 B2
(45) Date of Patent: Aug. 19, 2025

(54) UNDERGARMENT AND GARMENT LINER HAVING ADJUSTABLE SUPPORT FOR MALE GENITALIA

(71) Applicant: James G. Perez, St. Louis, MO (US)

(72) Inventor: James G. Perez, St. Louis, MO (US)

( * ) Notice: Subject to any disclaimer, the term of this patent is extended or adjusted under 35 U.S.C. 154(b) by 0 days.

(21) Appl. No.: 18/642,476

(22) Filed: Apr. 22, 2024

(65) Prior Publication Data

US 2024/0292908 A1 Sep. 5, 2024

(51) Int. Cl.
*A41B 9/02* (2006.01)

(52) U.S. Cl.
CPC ..... *A41B 9/02* (2013.01); *A41B 2300/22* (2013.01)

(58) Field of Classification Search
CPC ..... A41B 9/008; A41B 9/007; A41B 9/02
USPC ..... 2/403; 602/67–71
See application file for complete search history.

(56) References Cited

U.S. PATENT DOCUMENTS

| | | | | |
|---|---|---|---|---|
| 64,766 A | | 5/1867 | Heaton | |
| 77,757 A | | 5/1868 | Phelps | |
| 214,888 A | | 4/1879 | Cooper et al. | |
| 265,672 A | | 10/1882 | Hart | |
| 286,657 A | | 10/1883 | Ware | |
| 531,232 A | | 12/1894 | Teuscher, Jr. | |
| 713,318 A | | 11/1902 | Lovis | |
| 850,298 A | | 4/1907 | De Mars | |
| 908,533 A | | 1/1909 | Zuckriegel | |
| 967,736 A | | 8/1910 | Delp | |
| 1,019,501 A | | 3/1912 | Love et al. | |
| 1,020,588 A | | 3/1912 | West | |
| 1,023,478 A | | 4/1912 | O'Reilly | |
| 1,206,525 A | | 11/1916 | Force | |
| 1,254,463 A | * | 1/1918 | Arrington | A41B 9/02 2/400 |
| 1,350,863 A | | 8/1920 | Fowler | |
| 1,429,510 A | | 9/1922 | Maida | |
| 1,477,187 A | | 12/1923 | Rayne | |
| 1,483,351 A | * | 2/1924 | Keirstead | A61F 5/40 602/70 |
| 1,638,525 A | | 8/1927 | Chisholm | |
| 1,742,399 A | | 1/1930 | Klein | |
| 2,035,604 A | | 3/1936 | Ide | |
| 2,254,863 A | | 9/1941 | Weihe | |
| 2,293,998 A | | 8/1942 | Norwood | |
| 2,320,736 A | * | 6/1943 | Nevins | A61F 5/40 602/70 |

(Continued)

*Primary Examiner* — Gloria M Hale
(74) *Attorney, Agent, or Firm* — Brian P. Klein; David E. Crawford; Fast Forward Law, LLC

(57) ABSTRACT

A garment for supporting the male genitalia of a wearer includes a waistband with a series of circumferentially oriented slits spaced along the front. A back strap attaches to a back strip of the waistband and extends downward from the waistband to a lower end. A pouch with a rearward end connected to the lower end of the back strap extends forward covering a lower extreme of a wearer's abdomen. A pair of cuffs attach to opposite sides of the forward end of the pouch. A pair of laces connected to the forward end of the pouch thread inside through respective tubular passages of the cuffs, extending upward through different slits in the front of the waistband. The wearer can select the spacing of the laces extending through the slits and the tightness of the laces to customize the pouch shape and tightness for a desired fit.

20 Claims, 5 Drawing Sheets

(56) References Cited

U.S. PATENT DOCUMENTS

| | | | | | |
|---|---|---|---|---|---|
| 2,427,428 | A | | 9/1947 | Vitale | |
| 2,686,517 | A | | 8/1954 | Boyd | |
| 2,746,456 | A | | 5/1956 | Camillis | |
| 2,798,484 | A | | 7/1957 | Boudreaux | |
| 2,888,014 | A | | 5/1959 | Dougherty | |
| 3,225,761 | A | | 12/1965 | Swensen | |
| 3,314,422 | A | | 4/1967 | Phillips | |
| 3,518,995 | A | | 7/1970 | Claff | |
| 3,550,590 | A | | 12/1970 | Keilman | |
| 4,122,849 | A | | 10/1978 | Dietz | |
| 4,141,357 | A | * | 2/1979 | Dietz | A41B 9/023 602/73 |
| 4,195,630 | A | | 4/1980 | Connery | |
| 4,505,707 | A | | 3/1985 | Feeney | |
| 4,576,599 | A | | 3/1986 | Lipner | |
| 4,627,846 | A | | 12/1986 | Ternstrom | |
| 4,660,551 | A | | 4/1987 | Nishimura | |
| 4,660,554 | A | | 4/1987 | Wright | |
| 4,731,063 | A | | 3/1988 | Newkirk | |
| 4,961,419 | A | | 10/1990 | Tribble et al. | |
| 5,029,345 | A | | 7/1991 | Angheluta | |
| 5,157,793 | A | | 10/1992 | Michels | |
| 5,275,592 | A | * | 1/1994 | Grizzaffi | A61F 5/4401 2/403 |
| 5,283,912 | A | | 2/1994 | Chung | |
| 5,401,266 | A | | 3/1995 | Runeman et al. | |
| 5,524,298 | A | | 6/1996 | Plunkett | |
| 5,547,466 | A | | 8/1996 | McRoberts et al. | |
| 5,647,065 | A | | 7/1997 | Richerson | |
| 5,807,299 | A | | 9/1998 | McRoberts et al. | |
| 6,038,703 | A | | 3/2000 | Chung | |
| 6,245,036 | B1 | | 6/2001 | McRoberts et al. | |
| 6,820,284 | B2 | * | 11/2004 | Horikoshi | A41B 9/023 2/403 |
| 7,676,853 | B1 | | 3/2010 | Cutlip | |
| 8,336,120 | B2 | | 12/2012 | Wong | |
| 9,687,382 | B2 | | 6/2017 | Beerman et al. | |
| 9,717,281 | B2 | * | 8/2017 | Mehrabian | A61F 13/56 |
| 10,085,492 | B2 | | 10/2018 | Polidan et al. | |
| 2004/0031088 | A1 | | 2/2004 | Soderstrom | |
| 2005/0268380 | A1 | | 12/2005 | Sovell | |

* cited by examiner

UNDERGARMENT AND GARMENT LINER HAVING ADJUSTABLE SUPPORT FOR MALE GENITALIA

CROSS-REFERENCE TO RELATED APPLICATIONS

The present application claims benefit of co-pending U.S. Provisional Patent Application No. 63/440,792 entitled, "GARMENT HAVING ADJUSTABLE SUPPORT FOR MALE GENITALIA" filed Jan. 24, 2023, which is hereby incorporated by reference in its entirety.

BACKGROUND OF THE INVENTION

The present disclosure is directed to an undergarment, garment liner, and support garment for male genitalia, and more particularly to an adjustable undergarment, garment liner, and support garment providing improved support, comfort, and appearance.

Conventional male genitalia support garments, which are commonly referred to as athletic supporters or jock straps, have a broad elastic waistband. One side of a triangular mesh cup is attached to a central front portion of the waistband. The opposite corner of the cup extends to a location generally behind the wearer's scrotum. Two straps are attached to the cup at this location. Each strap extends rearward and upward on opposite sides of the wearer's buttocks to the waistband where it is attached to the waistband.

Usually, these garments are sized by waist circumference. The waistband has an unstretched circumference that is slightly smaller than the wearer's waist. The waistband stretches to accommodate the wearer and contracts, so the garment remains in place on the wearer's waist without slipping or being so tight as to cause discomfort. In general, the cup size and strap lengths are the same size for every garment having a particular waistband circumference from a particular maker. Although this sizing scheme is adequate for many wearer's, some wearer's having waist circumferences or genital volumes outside common size ranges are not accommodated. For example, wearing a garment that is sized too large can reduce the ability of the garment to support the wearer. In contrast, wearing a garment that is sized tool small can cause discomfort. Even among those for whom the sizing scheme provides adequate garment sizing, the system may be less than optimal. For example, an athletic supporter that is properly sized when used with a protective cup may provide inadequate support when the cup is not present. Further, an athletic supporter that fits properly before an activity may become improperly sized after an extended period of wear or when ambient temperature changes. Moreover, a wearer may need the support of an athletic supporter during a particular athletic activity, but may then be required to wear the athletic support garment before and after such activities with no ability to adjust the fit or support provided by the garment.

In view of the drawbacks present in currently available athletic supporters, there remains a need for an improved alternative garment that provides optimal sizing regardless of wearer anatomy and wearing condition, and a garment that offers a wearer an opportunity for improved support, comfort, and appearance.

SUMMARY

In one aspect, the present disclosure includes a garment for supporting a male wearer's genitals. The garment comprises a waistband having a circumferential length corresponding to a wearer's waist and having an interior face adapted to face the wearer. The waistband further comprises a back strip configured to overlay a wearer's back and a front strip configured to overlay a wearer's front. The front strip has a series of circumferentially oriented slits spaced at intervals along the front strip. The garment further comprises a back strap having an upper end attached to the back strip of the waistband and extending downward from the waistband to a lower end. The garment also comprises a pouch having a rearward end connected to the lower end of the back strap. The pouch extends forward from its rearward end to a forward end extending between opposite lateral ends and adapted to overlay a lower portion of a wearer's abdomen. The garment further comprises a pair of laces connected to the forward end of the pouch. Each lace of the pair of laces extends from a lower end attached to a corresponding lateral end of the forward end of the pouch and extends through a different selected slit of the series of the circumferentially oriented slits and through the front strip of the waistband to an upper end. The different selected slits are spaced by a distance chosen to customize a shape and tightness of the pouch.

In another aspect, the present disclosure includes a method for adjusting a garment for supporting a male wearer's genitalia. The garment comprises a waistband having a circumferential length corresponding to a wearer's waist. The waistband has a front strip configured to overlay a wearer's front. The front strip has a series of circumferentially oriented slits spaced at intervals along the front strip. The garment further comprises a back strap attached to a back of the waistband and extending downward from the waistband to a lower end. The garment further comprises a pouch having a rearward end connected to the lower end of the back strap and extending forward from its rearward end to a forward end. The pouch is adapted to overlay a lower portion of a wearer's abdomen. The garment further comprises a pair of laces connected to the forward end of the pouch. With this type of garment, the method comprises selecting a garment having an appropriately sized waistband adapted to fit the wearer. The method further comprises stepping into the waistband and pulling the waistband into position on the wearer's waist. The method also comprises reaching between the wearer's legs to reach the laces and pulling the laces upward so the pouch overlays a lower portion of a wearer's abdomen. The method further comprises threading each lace through a respective, selected slit of the waistband so the pouch has a desired width. The method further comprises pulling each lace upward through the respective slit until the pouch has a desired tightness and tying together the laces above the slits to maintain a desired fit of the pouch.

Other aspects of the present disclosure will be apparent in view of the following description and claims.

BRIEF DESCRIPTION OF DRAWINGS

Corresponding reference characters indicate corresponding parts throughout the drawings.

DETAILED DESCRIPTION

Figure 1:
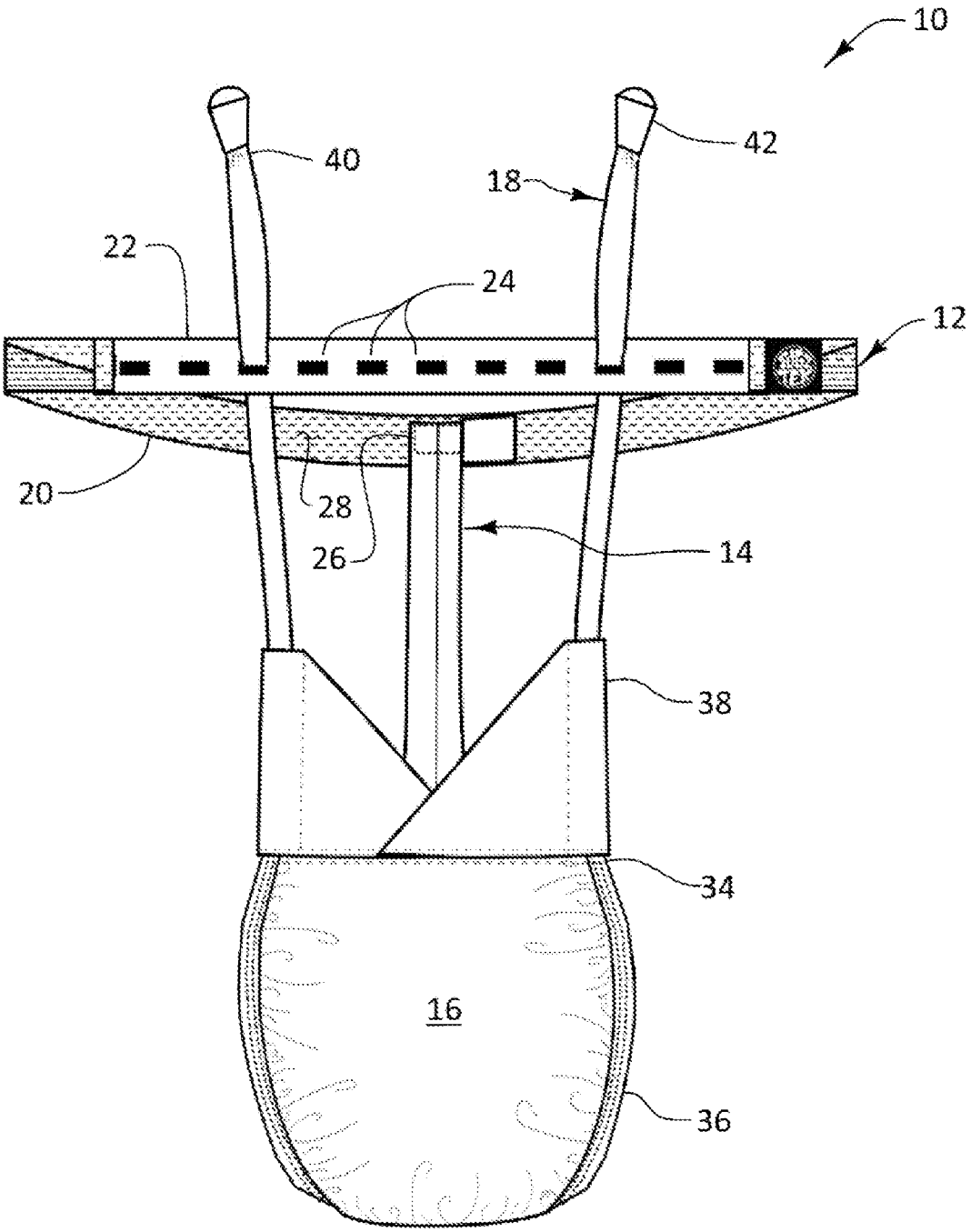
FIG. 1 is a schematic front elevation of an adjustable support garment for male genitalia as described herein.

As shown in FIG. 1, a garment allowing male genitalia to be supported is designated in its entirety by the reference character 10. The garment 10 includes a waistband, generally designated by 12, a back strap, generally designated by 14, a pouch, generally designated by 16, and a pair of ties or laces, generally designated by 18. The waistband 12 includes a back strip 20 and a front strip 22 joined by conventional methods. Although the back strip 20 may have other dimensions, the illustrated back strip has a width of about ¾ inches. The illustrated back strip 20 is made from an elastic material. Although the front strip may be made from other materials, the illustrated front strip 22 is made from knitted polyester and latex. The front strip 22 is knitted to form a series of circumferentially oriented slits 24 spaced at intervals along the front strip and located about halfway between an upper edge and a lower edge of the front strip. As used herein, the term circumference or circumferentially means extending around a generally oblong perimeter, such as a wearer's waist. Although the slits may have other dimensions, the illustrated slits 24 each has a length of about ½ inch. Although the front strip and back strip may have other dimensions, the illustrated front strip 22 has a width corresponding to the width of the back strip 20. Similar to conventional athletic supporters, the waistband 12 has an unstretched circumference shorter than a circumference of an intended wearer's waist. For example, the illustrated waistband 12 has a length between about 1 inch and about 2 inches shorter than the intended wearer's waist size. The circumferential length may vary from the illustrated example, but the length is intended to be selected to keep the garment 10 in position around a wearer's waist without slipping and without causing discomfort after an extended period of use.

Figure 2:
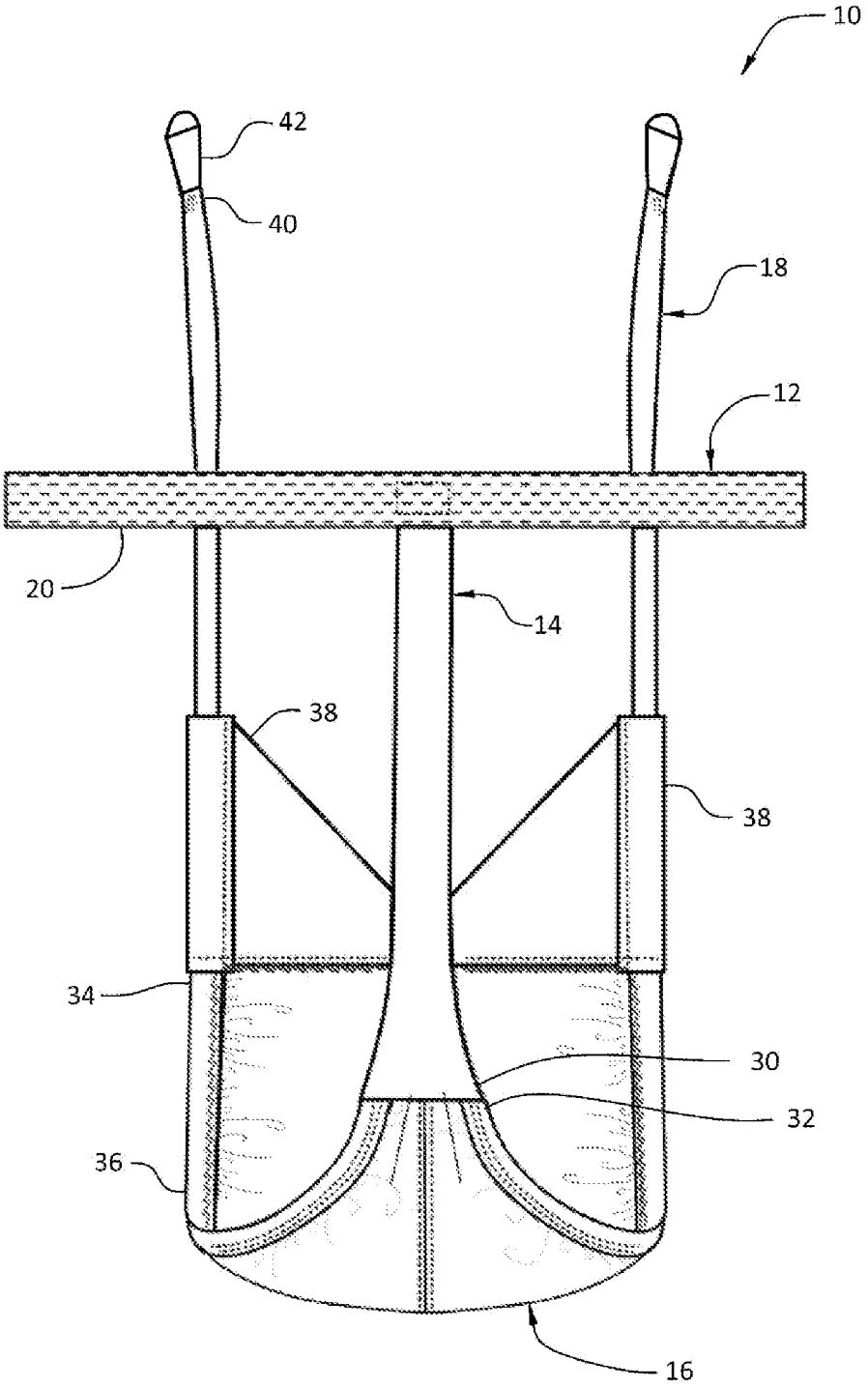
FIG. 2 is a schematic rear elevation of the garment shown in FIG. 1.
Figure 3:
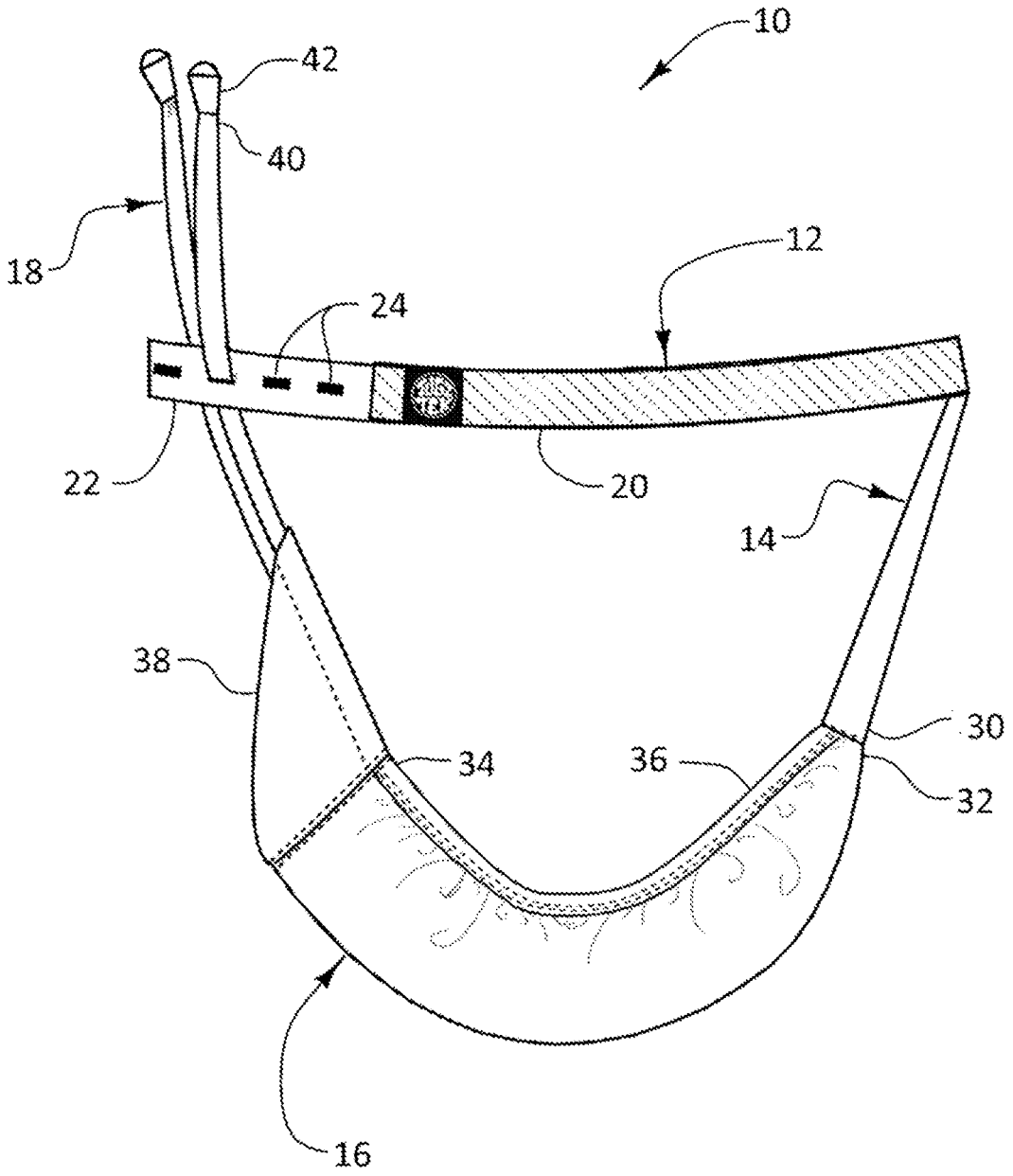
FIG. 3 is a schematic side elevation of the garment shown in FIG. 1.

As illustrated in FIGS. 1-3, an upper end 26 of the back strap 14 is attached to an interior face 28 of the waistband 12 so the back strap extends downward from the waistband below a center of the wearer's back to a lower end 30 connected to the pouch 16. Although other methods may be used to attach the back strap to the waistband and the pouch, the illustrated back strap 14 is joined to the waistband 12 and pouch 16 by sewing using a conventional stitch and technique. In the illustrated example, the back strap 14 becomes wider toward its lower end 30 (see FIG. 2). The illustrated back strap 14 has a width at its lower end 28 sized to match a rearward end 32 of the pouch 16. Although the back strap may have other dimensions, the back strap 14 of the illustrated example has a length of about 7¾ inches, a width of about ¾ inches at its upper end 26 and a width of about 1¼ inches at its lower end 30. The back strap 14 may be made of any suitable material such as nylon, polyester, or cotton. In the illustrated example, the back strap 14 is made from fabric sewn into a conical shape. As will be appreciated, the selected backstrap length results in the rearward end 32 of the pouch 16 being located behind the wearer's scrotum and in front of the wearer's anus, overlying the perineum. It should be understood that the back strap 14 shown in FIGS. 1-3 may comprise two or more back straps with two or more upper ends 26 positioned in different locations along the waistband 12. For example, two, separate right and left back straps 14 (not shown) extending from the rearward end 32 of the pouch 16 and adapted to extend upwardly, separately across the buttocks of the user to upper ends 26 attached to respective right and left lateral edges of the waistband 12 are contemplated.

The pouch 16 extends forward from its rearward end 32 to a forward end 34 extending between opposite lateral ends and adapted to overlay a lower portion of a wearer's abdomen. An elastic strip 36 is sewn onto the pouch 16 along its lateral edges as shown, causing the lateral edges to contract as shown to provide a cup shape. Although the pouch may have other dimensions, the pouch 16 of the illustrated example has a generally uniform width of about six inches and a fully extended length of about twelve inches. For example, in another example of a pouch, the forward end 34 of the pouch 16 is wider than the rearward end 32 of the pouch. Although the pouch 16 may be made of other suitable materials such as nylon or polyester, the illustrated pouch 16 is formed from knitted polyester sport mesh to improve breathability and thereby enhance the wearer's comfort, in particular when the wearer perspires, such as during exercise or activity.

As further illustrated in FIGS. 1-3, the laces 18 are connected to the forward end 34 of the pouch 16. In the illustrated example, a pair of triangular connectors, or cuffs 38 are attached to the forward end 34 of the pouch 16 using a conventional stitch and technique. Each cuff 38 is stitched to create a tubular passage generally aligned with an outer lateral edge of the cuff. The laces 18 are threaded through the tubular passages of the cuffs. Each of the laces 18 extends from a lower end (not visible) attached to the forward end 34 of the pouch 16 inside the tubular passages of the cuffs 38 to an upper end 40. Although the laces may have other lengths, the laces 18 of the illustrated garment 10 each has a length of about twelve inches to about fourteen inches. In addition, the laces 18 of the illustrated example have a width of about ⅜ inch. As will be appreciated, the cuffs 38 distribute lace loading across the forward end 34 of the pouch 16 to improve the wearer's comfort. Although laces may be made from other suitable materials such as nylon, polyester, or cotton, the illustrated laces 18 are made by sewing knitted polyester sport mesh fabric into tubes. Further, the upper ends 40 of the illustrated laces 18 include a molded plastic cap 42 to finish the lace, preventing fraying during use.

Figure 4:
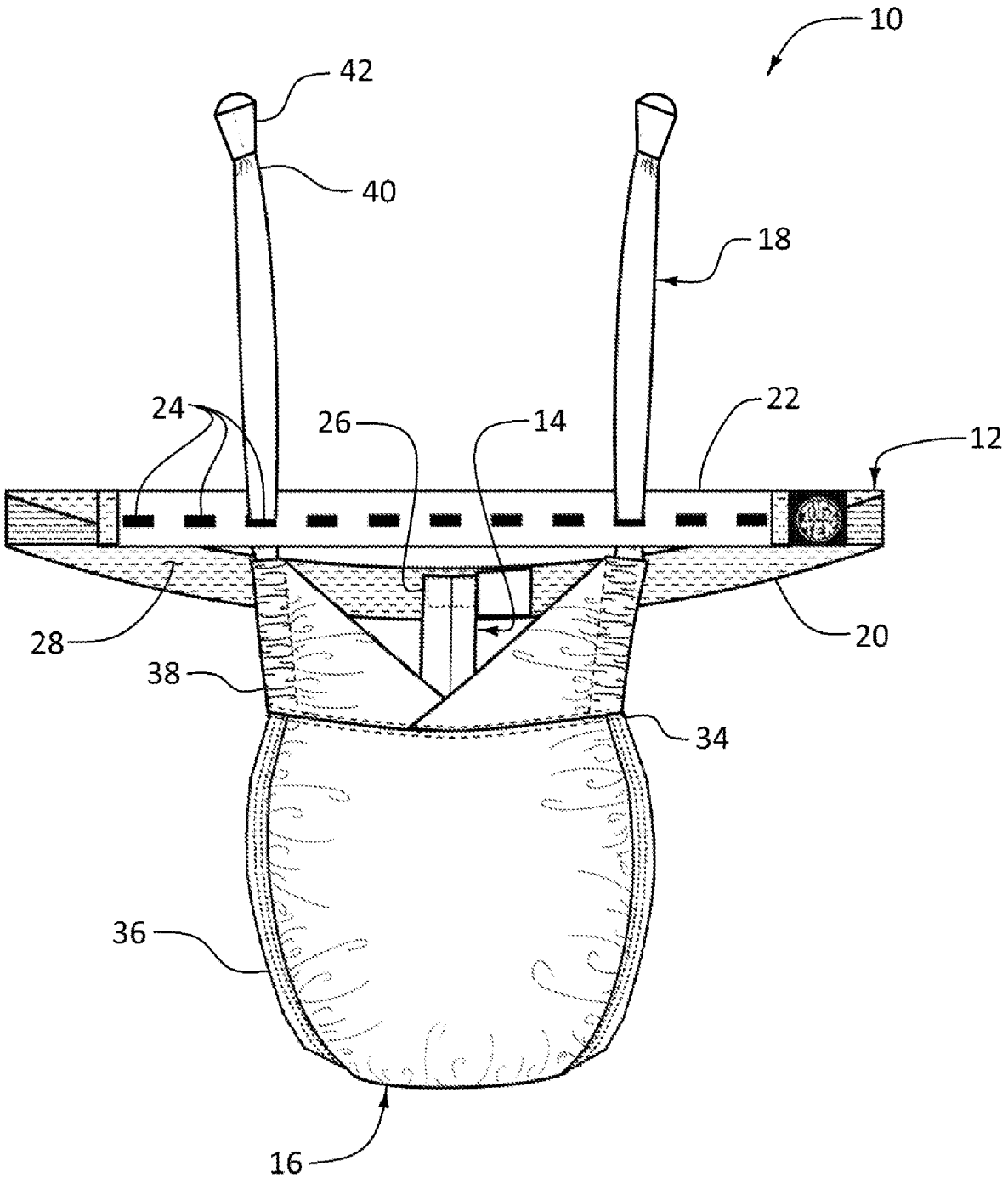
FIG. 4 is a schematic front elevation of the garment shown in a tightened configuration.
Figure 5:
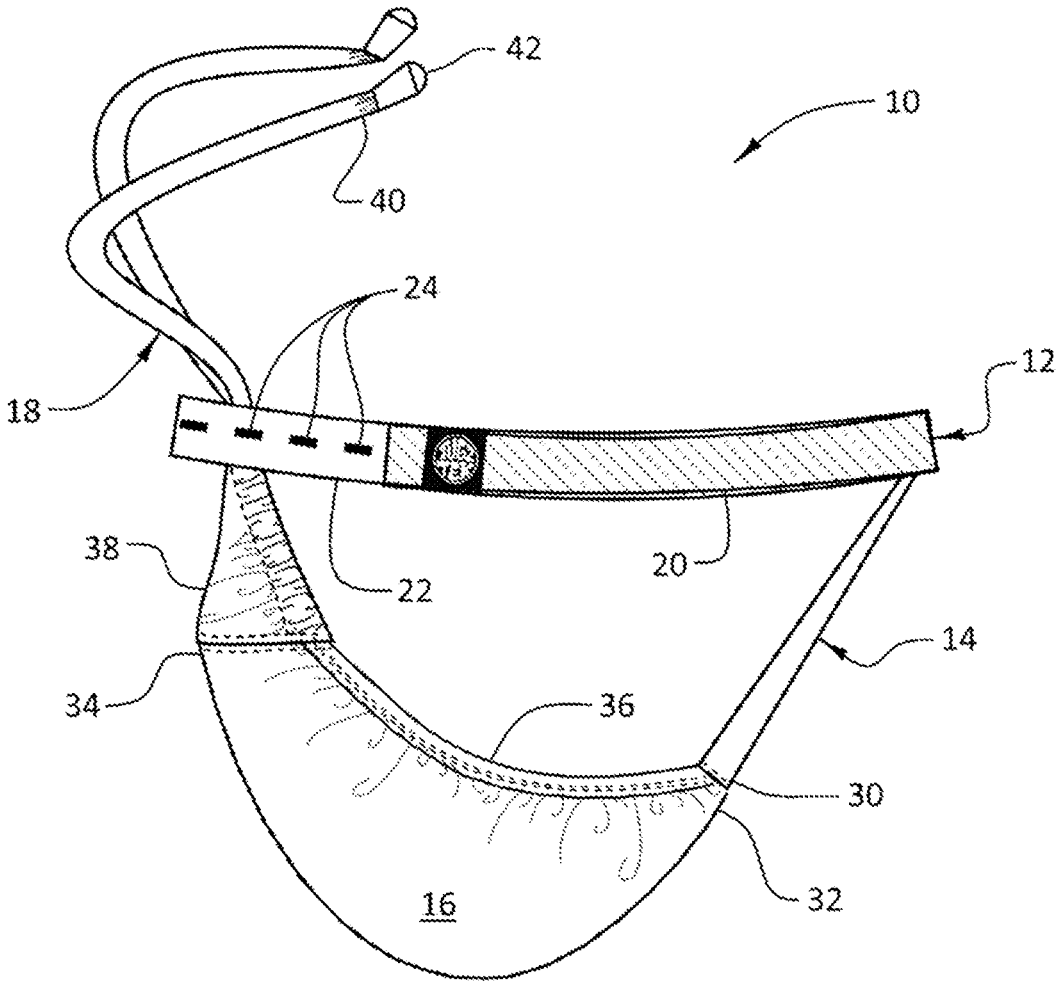
FIG. 5 is a schematic side elevation of the garment shown in a tightened configuration.

Each of the laces 18 extends upward through a selected slit 24 in the front strip 22 of the waistband 12. Those skilled in the art should appreciate that the laces 18 may extend through any selected slit 24 to adjust the location and spacing of the laces to customize the pouch 16 shape and position for a desired fit. For example, the width of the pouch 16 may be made narrower or wider by threading the laces 18 through more central or lateral slits 24, respectively. In addition, the lateral location of the pouch 18 may be shifted left or right relative to a centerline of the wearer by threading the laces through more leftward or rightward slits 24, respectively. With the laces 18 threaded through slits 24, the laces are drawn upward to raise the forward end 34 of the pouch 16 as shown in FIGS. 4 and 5. When the laces are drawn, the cuffs 38 may gather as shown to permit a distance between the forward end 34 of the pouch 16 and the waistband 12 to be shortened. The laces 18 are tied together above the slits 24 to maintain a desired fit of the pouch. With the laces drawn, the pouch 16 is drawn against the genitals of the wearer with the elastic strips 36 positioned between the respective thighs and abdomen of the wearer.

To use the garment 10, a wearer selects a garment having an appropriately sized waistband 12. After stepping into the waistband 12, the wearer pulls the waistband into position on his waist. If the waistband 12 fit it too loose or too tight, the wearer can select a smaller or larger garment, respectively. The wearer reaches between his legs to reach the laces 18. The wearer pulls the laces 18 upward so the pouch 16 is generally in a desired position, before threading each lace through selected slits 24 inside the waistband 12. After pulling the laces 18 upward until the pouch 16 has a desired tightness, the wearer ties the laces over the slits 24. To readjust the garment 10, a wearer unties the laces 18 and readjusts the pouch 16. Once the pouch 16 is in a desired position, the wearer reties the laces 18 over the slits. Although the wearer may untie and unthread the laces 18 before each use, it will be appreciated that some wearers may choose not to readjust the pouch 16 sizing and position between uses.

Although the garment 10 is described as a support garment such as an athletic supporter, it is envisioned the garment may also be used as an undergarment, loungewear, swimwear, or as a supportive liner within a pair of pants, shorts, or swim trunks. The wearer can adjust the fit of the garment 10 throughout a single use, depending upon the wearer's current activity. For example, a wearer may need to tie the laces 18 tightly to provide the enhanced support of an athletic supporter during a particular athletic activity. Later during the same wearing session, the wearer may readily untie and loosen the laces 18 or rethread the laces through different slits 24 to loosen and reposition the garment 10 to participate in less athletic activities. In this manner, a wearer can easily wear the athletic support garment 10 before, during, and after such athletic activities with an ability to adjust the fit or support provided by the garment as needs change.

As various changes could be made to the constructions and methods described herein, it is intended that all matter contained in the above description or shown in the accompanying drawings shall be interpreted as illustrative and not in a limiting sense. The patentable scope of the disclosure is defined by the claims, and can include other constructions and methods that would occur to those skilled in the art. Such other constructions are intended to be within the scope of the claims if the structural elements of the constructions do not differ from the literal language of the claims, or if the constructions include equivalent structural elements having insubstantial differences from the literal languages of the claims.

To the extent that the specification, including the claims and accompanying drawing, discloses any additional subject matter that is not within the scope of the claims below, the disclosures are not dedicated to the public and the right to file one or more applications to claims such additional disclosures is reserved.

When introducing in this description and the claims, the articles "a", "an", "the" and "said" are intended to mean that there are one or more of the elements. The terms "comprising", "including" and "having" are intended to be inclusive and mean that there may be additional elements other than the listed elements.

The invention claimed is:

1. A garment for supporting a male wearer having an anus and genitals including a scrotum, the scrotum positioned in front of the anus, said garment comprising:

a waistband having a circumferential length corresponding to a wearer's waist and having an interior face adapted to face the wearer, said waistband further comprising a back strip configured to overlay a wearer's back and a front strip configured to overlay a wearer's front, said front strip having a series of circumferentially oriented slits spaced at intervals along the front strip;

a back strap having an upper end attached to the back strip of the waistband and extending downward from the waistband to a lower end;

a pouch having a rearward end connected to the lower end of the back strap, the pouch extending forward from its rearward end to a forward end extending between opposite lateral ends and adapted to overlay a lower portion of a wearer's abdomen; and a pair of laces connected to the forward end of the pouch, each lace of the pair of laces extends from a lower end attached to a corresponding lateral end of the forward end of the pouch and extends through a different selected slit of said series of the circumferentially oriented slits and through the front strip of the waistband to an upper end, wherein the different selected slits are spaced by a distance chosen to customize a shape and tightness of the pouch.

2. A garment as set forth in claim 1 further comprising a pair of connectors attached to opposite sides of the forward end of the pouch, each of said connectors includes a tubular passage generally aligned with an outer lateral edge of the connector, each lace of the pair of laces threads through a respective tubular passage.

3. A garment as set forth in claim 1 wherein the front strip comprises an upper edge and a lower edge, said circumferentially oriented slits are located about halfway between said upper edge and said lower edge of the front strip, and wherein the slits each has a length of about ½ inch.

4. A garment as set forth in claim 1 wherein the pouch further comprises lateral edges and an elastic strip sewn onto the pouch along each of said lateral edges.

5. A garment as set forth in claim 1 wherein the pouch has a generally uniform width of about six inches and a fully extended length of about twelve inches.

6. A garment as set forth in claim 5 wherein the pouch is formed from knitted polyester sport mesh.

7. A garment as set forth in claim 1 wherein the forward end of the pouch is wider than the rearward end of the pouch.

8. A garment as set forth in claim 1 wherein the back strap becomes wider toward its lower end.

9. A garment as set forth in claim 8 wherein the back strap is made from fabric sewn into a conical shape.

10. A garment as set forth in claim 1 wherein the backstrap length is selected to position the rearward end of the pouch behind the scrotum and in front of the anus.

11. A garment as set forth in claim 10 wherein the back strap has a width at its lower end sized to match a width of a rearward end of the pouch.

12. A garment as set forth in claim 11 wherein the back strap has a length of about 7¾ inches, a width of about ¾ inches at its upper end and a width of about 1 1/4 inches at its lower end.

13. A garment as set forth in claim 1 wherein the waistband has an unstretched circumference between about 1 inch and about 2 inches shorter than a circumference of the wearer's waist to keep the garment in position around the wearer's waist.

14. A garment as set forth in claim 1 wherein the back strip is made from an elastic material.

15. A garment as set forth in claim 14 wherein the front strip is made from knitted polyester and latex.

16. A garment as set forth in claim 1 wherein each lace of the pair of laces has a length of about twelve inches to about fourteen inches and a width of about ⅜ inch.

17. A garment as set forth in claim 1 wherein the laces are made by sewing knitted polyester sport mesh fabric into tubes.

18. A garment as set forth in claim 1 wherein the back strap comprises a left back strap and a right back strap, the left back strap extending downward from a left side of the back strip to a lower end and the right back strap extending downward from a right side of the back strip to a lower end, the lower ends of the left back strap and the right back strap being connected to the rearward end of the pouch.

19. A method for adjusting a garment for supporting a male wearer's genitalia, said male wearer having a pair of legs extending downward below the wearer's genitalia, a left leg of said pair of legs being positioned on a left side of the wearer's genitalia and a right leg of said pair of legs being positioned on a right side of the wearer's genitalia, the garment comprising (i) a waistband having a circumferential length corresponding to a wearer's waist, said waistband having a front strip configured to overlay a wearer's front, said front strip having a series of circumferentially oriented slits spaced at intervals along the front strip, (ii) a back strap attached to a back of the waistband and extending downward from the waistband to a lower end, (iii) a pouch having a rearward end connected to the lower end of the back strap and extending forward from its rearward end to a forward end, wherein the pouch is adapted to overlay a lower portion of a wearer's abdomen and at least a portion of the pouch comprises an elastic material, and (iv) a pair of laces connected to the forward end of the pouch, said method comprising:

selecting a garment having an appropriately sized waistband adapted to fit the wearer;

stepping into the waistband;

pulling the waistband into position on the wearer's waist;

moving the pair of laces between the pair of legs and upward so the pouch overlays a lower portion of a wearer's abdomen;

threading each lace of said pair of laces through a selected slit of the waistband to locate the pouch in a desired position;

pulling each lace of said pair of laces upward through the respective slit until the pouch has a desired tightness; and tying the pair of laces together above the slits to maintain a fit of the pouch.

20. A method as set forth in claim 19 further comprising untying the pair of laces and readjusting at least one pouch characteristic of a group of pouch characteristics consisting of the position of the pouch and the tightness of the pouch to change the fit of the pouch.

* * * * *